United States Patent [19]

Kopian

[11] Patent Number: 4,908,001

[45] Date of Patent: Mar. 13, 1990

[54] SOFT LATEX FIGURE AND METHOD OF MAKING THE SAME

[76] Inventor: Thomas O. Kopian, 21 Roslyn Dr., Glen Head, N.Y. 11545

[21] Appl. No.: 209,199

[22] Filed: Jun. 20, 1988

[51] Int. Cl.[4] ..... A63H 3/36

[52] U.S. Cl. ..... 446/385; 156/61; 156/62.6; 156/307.7; 434/82

[58] Field of Search ..... 446/385, 268; 434/82; 156/61, 63, 156, 297, 307.4, 307.7, 62.6, 62.2

[56] References Cited

U.S. PATENT DOCUMENTS

| | | | |
|---|---|---|---|
| 1,920,372 | 8/1933 | Fulton | 446/385 X |
| 2,081,071 | 5/1937 | Scovil et al. | 156/61 |
| 2,606,398 | 8/1952 | Miller | 446/385 |
| 4,297,153 | 10/1981 | Erickson et al. | 446/268 X |
| 4,397,701 | 8/1983 | Johnson et al. | 446/385 X |

*Primary Examiner*—Mickey Yu
*Attorney, Agent, or Firm*—Kenneth A. Roddy

[57] ABSTRACT

A soft latex figure is formed by sculpting clay appendages, making a plaster casting of the appendages, slush molding a colored pre-vulcanized latex replica of the appendage in the plaster mold, wrapping a form or base structure representing the torso with batting, and securing the molded latex appendages in position on the form. Strips of paper toweling saturated with colored pre-vulcanized latex are applied to the form and juncture of the molded latex appendages therewith to form a integral first layer of the outer skin of the figure having the appendages joined thereto. The first layer of the skin is cut or otherwise removed from the form, and stuffed with a quantity of soft fill material of desired density to achieve the desired shape retention characteristics of the figure. Any undesired seams, holes, or openings are sealed by applying more latex saturated paper toweling thereover. The first layer of skin is then coated with a sufficient quantity of colored liquid latex until the texture of the paper toweling is no longer visible and the desired strength and thickness is achieved. After the latex coating has dried, portions of the latex figure are painted to add finishing touches or create any additional features, highlights, or shadows, desired for the finished effect.

15 Claims, 1 Drawing Sheet

SOFT LATEX FIGURE AND METHOD OF MAKING THE SAME

BACKGROUND OF THE INVENTION

1. Field of the Invention

This invention relates generally to latex sculpting methods, and more particularly to a method of manufacturing latex figures using latex saturated paper toweling to cover a form, join slush molded latex appendages to the form, and become the first layer of a skin which is removed from the form and stuffed with soft fill material then sealed with additional latex saturated strips and coated with latex until the toweling is no longer visible.

2. Brief Description of the Prior Art

Figures, such as animals or dolls, have been made from various material compositions and coated with rubber substances. Other figures have been made entirely of molded rubber and may be manufactured in either solid or hollow form. Most prior art rubber figures are expensive to fabricate and require expensive machinery and molds. Many rubber figures require vulcanization which is time consuming and costly. Because of the expensive tooling and die costs required, many prior art rubber figures do not have detailed features which may be achieved by sculpting. Another popular type of animal or doll figure is known in the toy trade as a "plush" item. These "plush" figures, such as teddy bears for example, are filled with a soft or resilient material and have an outer covering of fabric and furr to give them a soft and squeezable quality.

Because of the fabric outer covering, most "plush" figures lack detailed features, or if any, they are sewn into the fabric. These plush figures, while having a desirable soft squeezable quality, lack detailed features which- may be achieved by sculpting.

It would therefore be desirable to provide a method of inexpensively manufacturing a new and improved figure having a humanlike outer skin and the soft squeezable qualities of the plush figures and detailed sculptured features.

There are several patents which disclose various sculpting methods utilizing latex materials.

Fischer, U.S. Pat. No. 2,325,385 discloses a method of impregnating paper, felt, or the like with rubber latex which is directed to providing a uniform rate of impregnation as the latex bath is being utilized to maintain the original ratio of rubber solids to non-rubber solids present in the bath.

Pereira, U.S. Pat. No. 2,185,924 discloses a process for making relief maps wherein a mold is sprayed with latex, glue is applied to a textile backing sheet, and after the glue has dried, a thin film of dilute latex is sprayed over the glue. The cavities between the two sheets are filled with cotton or felt fiber.

Frisch U.S. Pat. No. 1,979,031 discloses a method coating dolls with colored latex to simulate the feel of human skin. The molded doll is made in the conventional manner, then dipped in a rubber compound and the solvent is allowed to evaporate. The doll is then dusted to remove the natural rubber tackiness and to give the desired gloss and feel. The doll is then vulcanized by heat or by dipping in sulphur chloride, then in a rinse solution.

Carter, U.S. Pat. No. 2,308,971 discloses a method for filling a mold with latex using a vacuum to draw the latex into a mold in a vulcanizing chamber, gelling and vulcanizing the latex in the mold.

Fulton, U.S. Pat. No. 1,920,372 discloses a papier-mache figure covered with latex rubber by dipping or spraying.

Although these patents teach various sculpting methods and the utilization of latex materials, they do not suggest present method of making soft latex figures.

The present invention is distinguished over the prior art in general, and these patents in particular by a method of manufacturing soft latex figures by sculpting clay appendages, making a plaster casting of the appendages, slush molding a colored pre-vulcanized latex replica of the appendage in the plaster mold, wrapping a form or base structure representing the torso with batting, and securing the molded latex appendages in position on the form. Strips of paper toweling saturated with colored pre-vulcanized latex are applied to the form and juncture of the molded latex appendages therewith to form a integral first layer of the outer skin of the figure having the appendages joined thereto. The first layer of the skin is cut or otherwise removed from the form, and stuffed with a quantity of soft fill material of desired density to achieve the desired shape retention characteristics of the figure.

Any undesired seams, holes, or openings are sealed by applying more latex saturated paper toweling thereover. The first layer of skin is then coated with a sufficient quantity of colored liquid latex until the texture of the paper toweling is no longer visible and the desired strength and thickness is achieved. After the latex coating has dried, portions of the latex figure are painted to add finishing touches or create any additional features, highlights, or shadows, desired for the finished effect.

SUMMARY OF THE INVENTION

It is therefore an object of the present invention to provide a method of manufacturing soft latex figures which does not require expensive machinery and tooling thereby allowing soft latex figures to be produced at lower cost than present methods.

It is another object of this invention to provide a method of manufacturing soft latex figures which is quickly accomplished and eliminates vulcanization procedures and reduces the time required for coloring the figure.

It is another object of this invention to provide a method of manufacturing soft latex figures to create a figure having an outer skin simulative of the human skin in texture and feel which is filled with soft materials to retain the shape of the figure while at the same time being soft and squeezable.

Another object of this invention is to provide a method of manufacturing soft latex figures wherein the detailed features of the figure are sculpted in clay or other modeling medium allowing artistic freedom and creativity on the part of the artisan.

Another object of this invention is to provide a method of manufacturing soft latex figures wherein a wide variety of custom made appendages may be easily incorporated into the overall shape and appearance of the figure.

Another object of this invention is to provide a method of manufacturing soft latex figures wherein appendages may be flexibly secured to the torso of the figure.

A further object of this invention is to provide a new and improved type of latex figure which is soft and squeezable and has an outer skin simulative of human skin which is strong and durable.

A still further object of this invention is to provide a new and improved type of latex figure which may be customed designed and is inexpensive to manufacture, and has quality construction.

Other objects of the invention will become apparent from time to time throughout the specification and claims as hereinafter related.

The above noted objects and other objects of the invention are accomplished by creating a soft latex figure by sculpting clay appendages, making a plaster casting of the appendages, slush molding a colored pre-vulcanized latex replica of the appendage in the plaster mold, wrapping a form or base structure representing the torso with batting, and securing the molded latex appendages in position on the form. Strips of paper toweling saturated with colored pre-vulcanized latex are applied to the form and juncture of the molded latex appendages therewith to form a integral first layer of the outer skin of the figure having the appendages joined thereto. The first layer of the skin is cut or otherwise removed from the form, and stuffed with a quantity of soft fill material of desired density to achieve the desired shape retention characteristics of the figure.

Any undesired seams, holes, or openings are sealed by applying more latex saturated paper toweling thereover. The first layer of skin is then coated with a sufficient quantity of colored liquid latex until the texture of the paper toweling is no longer visible and the desired strength and thickness is achieved. After the latex coating has dried, portions of the latex figure are painted to add finishing touches or create any additional features, highlights, or shadows, desired for the finished effect.

DESCRIPTION OF THE PREFERRED EMBODIMENT

Figure 1:
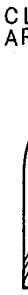
FIG. 1 is an elevational view illustrating a sculptured clay head appendage on a base form utilizing a jar as the form.
Figure 2:
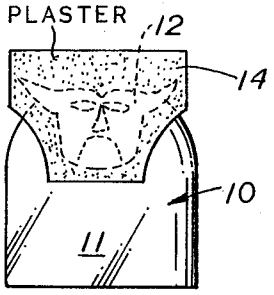
FIG. 2 illustrates the casting of the clay appendage in plaster to form a mold from which a latex replica of the clay appendage will be made.
Figure 3:
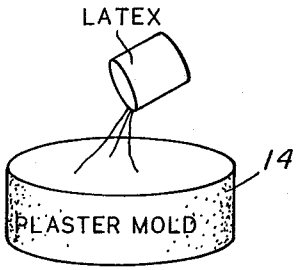
FIG. 3 illustrates the step of slush molding pre-vulcanized latex in the plaster mold.
Figure 4:
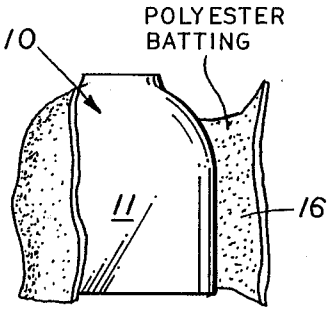
FIG. 4 illustrates the step of wrapping or covering the form with polyester batting.
Figure 5:
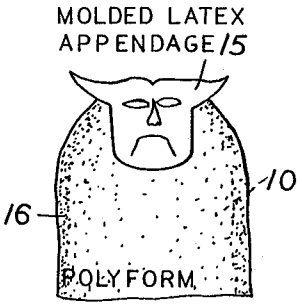
FIG. 5 shows the latex appendage formed in the plaster mold secured in place on the form.
Figure 6:
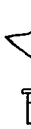
FIG. 6 illustrates the step of saturating pieces of paper toweling by running them through a bath of pre-colored, pre-vulcanized latex.
Figure 7:
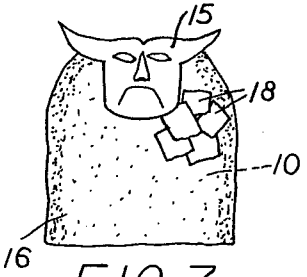
FIG. 7 shows the latex saturated paper toweling being applied to the form and overlapping the appendages to form the first layer of skin of the figure.
Figure 8:
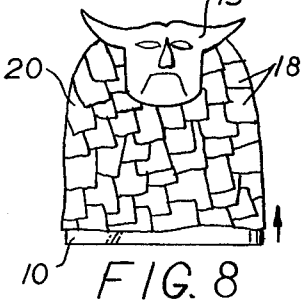
FIG. 8 shows the latex skin being removed from the form.
Figure 9:
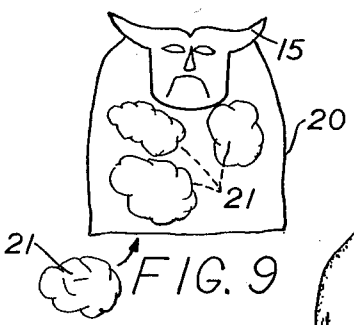
FIG. 9 illustrates stuffing the latex skin with cotton or polyester fill material.
Figure 10:
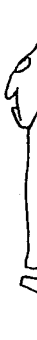
FIG. 10 illustrates sewing a piece of fabric to the latex skin to enclose the bottom opening.
Figure 11:
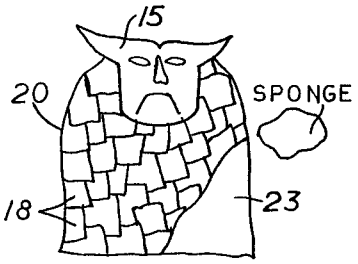
FIG. 11 shows the stuffed skin being coated with liquid latex until the toweling is no longer visible.
Figure 12:
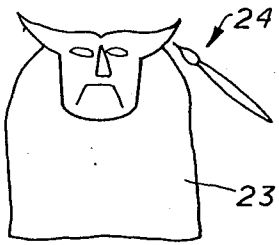
FIG. 12 illustrates painting additional features, highlights, shadows and other finishing touches on the latex skin of the figure.
Figure 13:
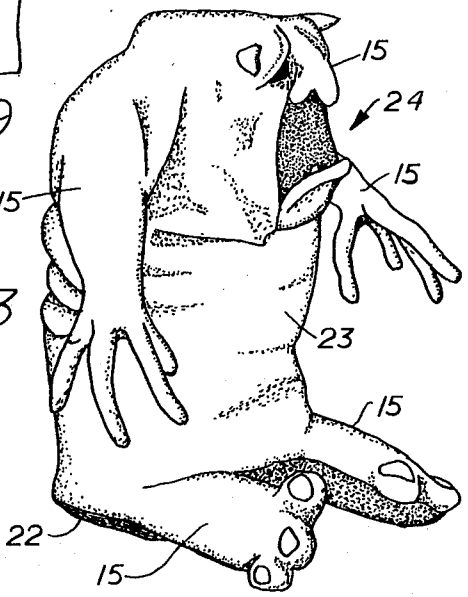
FIG. 13 illustrates a typical finished figure produced by the method of the present invention.

FIGS. 1–12 of the drawings are illustrations of the steps in the manufacturing process and are somewhat schematic. Only one appendage (the head) is shown for purposes of clarity and ease of understanding. It should understood than an infinite variety of appendages may also be incorporated into the figure using the same method.

The first step in the preferred method of manufacturing a soft latex, or "rubber plush" figure is to provide a supporting base structure or form 10 which approximates the size of the torso of the figure to be created. A suitable form may be any existing object, such as a jar 11, a box, a bottle, etc. A custom form may also be constructed of wire mesh or the like which is fashioned to approximate the size and shape of the figure.

After a suitable form 10 or base structure has been provided, a quantity of clay or other suitable modeling material 12 is applied to the form 10. The clay or modeling material 12 will be used to form the appendages of the figure, such as the head, arms, legs, hands, feet, etc. The clay 12 is then sculptured to produce the desired shape and detailed features of the appendage to be produced. Placing the clay 12 on the form allows the artisan to get a sense of the overall proportions of the figure and appendages, however, the clay appendages 12 may be sculpted while unattached to the form.

Plaster, or other suitable mold material is then applied to the sculptured appendages and allowed to harden to produce a mold 14 for forming the latex counterpart 15 of the clay appendages 12. The mold 14 may be made in one or more pieces for complex shapes, as is common in the art of mold making. Optionally, the mold 14 may also be reinforced with polyester resin if desired to produce a stronger and more durable mold.

Pre-vulcanized liquid latex rubber is poured into the plaster mold, and slush molded. Coloring material may also be mixed with the liquid latex prior to slush molding. This process may be repeated a number of times to achieve the desired thickness and strength for the appendage. Use of pre-vulcanized liquid latex greatly reduces the time required to mold the appendages and eliminates the vulcanization process.

The clay appendages 12 are removed from the form 10, and the form is wrapped or covered with a suitable polyester batting material 16. The batting material 16 adds to the softness of the outer skin to be subsequently created and will allow the outer skin to be easily separated from the form. This step is optional depending upon the form surface and the consistancy of the liquid latex used.

The molded latex appendages 15 formed in the plaster mold 14 are placed on the form 10 in the appropriate positions. A suitable adhesive may be used to temporarily secure the latex appendages 15 on the form 10. This will have no affect on the finished product.

A quantity of pre-vulcanized liquid latex is poured into a tray or other suitable open-top container and coloring material is mixed thoroughly with the latex to form a colored latex bath 17 having the general color of the desired finished figure. The colored latex bath 17 reduces the time required to otherwise subsequently color the finished figure.

Conventional paper toweling 18 is cut or torn into strips of suitable size. The strips of paper toweling 18 are run through, or dipped in, the colored liquid latex bath 17, and the excess liquid latex is squeezed out or shaken off.

The latex saturated paper toweling strips 18 are then applied to the form 10 (or wrapped form), overlapping the attached molded latex appendages 15 at their juncture with the form and covering all of the exposed areas of the form. This forms the first layer 19 of the outer skin of the torso. Depending upon the type of paper toweling used, this first layer 19 may have the surface texture or "dimpled" appearance of the toweling and may resemble goose flesh.

The layer 19 of saturated paper toweling is allowed to dry, and after drying, the "skin" including the appendages joined thereto by the latex strips is removed from the form. The skin may be easily cut with scissors or a razor knife to remove it from the form. The skin and appendages are now one integral unit 20. If the batting 16 is used, the "skin" 20 will also have an inner lining of batting material.

The "skin" 20 is then stuffed with a suitable cotton or polyester fill material 21 of desired density. The more compactly the skin is stuffed, the better it will retain its shape.

After stuffing the skin 20, the seams created by cutting it to remove it from the form, and any other holes or openings are sealed by applying the previously described saturated paper toweling over the openings or seams. If the hole or seam is large and will rest on the bottom of the figure, a piece of fabric or other material may be sewn over the opening which will provide a strong and durable bottom piece 22. The bottom piece 22 will not compromise the overall effect or appearance of the figure and can prevent damage to the latex skin should the figure be placed on rough terrain.

After the skin 20 has been sealed, it is coated with colored pre-vulcanized liquid latex 23 until the toweling 18 is no longer visible, and the desired strength and thickness is achieved. The colored liquid latex 23 may be applied with a sponge or brush to effect a skin texture. This step forms the outer layer of skin and gives strength and overall color to the figure.

After the latex 23 has dried, portions of the FIG. 24 may be painted with a brush, or sprayed to add finishing touches or create any additional features, highlights, or shadows, desired for the finished effect. After painting the finishing touches, clothes or other accessories may be added to the figure.

The finished soft latex, or "rubber plush" FIG. 24 thus produced has an outer skin simulative of the human skin in texture and feel and is filled with soft materials to retain the shape of the figure while at the same time being durable, soft, and squeezable. This method also allows production of a figure having artistically sculpted detailed features with an infinite variety of custom made appendages.

While this invention has been described fully and completely with special emphasis upon a preferred method and product thereof, it should be understood that within the scope of the appended claims the invention may be practiced otherwise than as specifically described herein.

I claim:

1. A method of manufacturing soft latex figures comprising the steps of:

providing a form to serve as a supporting base structure which approximates the size and shape of the torso of the figure to be created, applying a soft modeling material to the form of sufficient size to form the appendages of the figure to be created, sculpting the soft modeling material to produce the desired shape of the appendages including the detailed features to be produced, applying a molding material to the sculptured appendages and allowing it to harden to produce a mold of the appendages, mixing coloring material with pre-vulcanized liquid latex rubber and pouring the liquid latex mixture into the mold, and slush molding the mixture therein to form a thin latex replica of the appendage cast in the mold, and repeating this step sufficient number of times to achieve the desired thickness and strength for the latex appendages, removing the sculpted appendages from the form and wrapping the form with a soft batting material, securing the molded latex appendages formed in the mold on the form in the appropriate positions, mixing a coloring material with pre-vulcanized liquid latex in a suitable container to form a colored latex bath having the general color of the desired finished figure, making strips of conventional paper toweling and saturating the strips in the colored liquid latex bath and thereafter removing the excess liquid latex from the paper toweling, applying the latex saturated paper toweling strips to the form, overlapping the attached molded latex appendages at their juncture with the form and covering all of the exposed areas of the form, and allowing the layer of saturated paper toweling to dry, during the drying process, the previously molded latex appendages becoming integrally joined to the layer of saturated paper toweling to form an integral first layer of the outer skin of the figure torso, cutting or otherwise removing the skin formed by the latex paper toweling and integral appendages from the form, stuffing the skin with a sufficient quantity of suitable soft fill material of desired density to achieve the desired shape retention characteristics of the figure, sealing any undesired seams, holes, or openings by applying latex saturated paper toweling thereover, coating the first layer of skin with a sufficient quantity of colored liquid latex until the texture of the paper toweling is no longer visible and the desired strength and thickness is achieved, and after the latex coating has dried, painting or otherwise coloring desired portions of the figure to add finishing touches or create any additional features, highlights, or shadows, desired for the finished effect.

2. The method according to claim 1 in wherein said form is provided by utilizing an existing object which approximates the size and shape of the torso of the figure to be created such as a jar, box, bottle, or the like.

3. The method according to claim 1 in wherein said form is constructed by manipulating wire mesh or the like to fashion base supporting structure approximate the size and shape of the figure to be created.

4. The method according to claim 1 wherein the soft modeling material is removed from the form prior to sculpting the soft modeling material to produce the desired shape of the appendage including the detailed features to be produced.

5. The method according to claim 1 wherein said step of applying a mold material to the sculptured appendages includes the further step of reinforcing the mold with a hardener.

6. The method according to claim 1 wherein said step of sealing any undesired seams, holes, or openings, comprises leaving an opening in the skin of the figure at a selected location and securing a piece of fabric over the opening.

7. The method according to claim 6 wherein the location of the opening is at the bottom of the figure, and said fabric is stronger and more durable than the latex skin to provide a strong and durable bottom piece for preventing damage to the latex skin should the figure be placed on rough terrain.

8. The method according to claim 1 including the further step of after painting or otherwise coloring the figure to add the finishing touches, adding clothes or other accessories to the figure.

9. A stuffed soft rubber figure comprising;

an outer skin including a torso formed of a layer of paper toweling saturated with colored pre-vulcanized latex closely resembling human skin in texture and feel and having sculpted detailed features, and an inner filling of soft material of sufficient density and compactness to resiliently maintain the shape of the figure, said outer skin having an inner lining of soft batting material.

10. The stuffed soft rubber figure according to claim 9 in which said outer skin includes at least one appendage of latex material integrally joined thereto.

11. The stuffed soft rubber figure according to claim 10 in which said first layer of said outer skin having a coating of colored pre-vulcanized liquid latex which substantially covers the texture of the paper toweling.

12. The stuffed soft rubber figure according to claim 11 in which said outer skin is painted or otherwise colored to define features, highlights, or shadows.

13. The stuffed soft rubber figure according to claim 11 in which said outer skin has an opening at a selected location, and a piece of fabric material secured over the opening.

14. A stuffed soft rubber figure comprising:

an outer skin including a torso formed of a layer of paper toweling saturated with colored pre-vulcanized liquid latex substantially covering the texture of the paper toweling and closely resembling human skin in texture and feel and having sculpted detailed features, said first layer of said outer skin having an inner lining of soft batting material, an inner filling of soft material of sufficient density and compactness to resiliently maintain the shape of the figure, and at least one appendage of latex material integrally joined to said outer skin.

15. A stuffed soft squeezable rubber figure comprising;

a soft, squeezable, outer skin including a torso formed of a layer of dried pre-vulcanized latex saturated paper toweling strips, with the latex substantially covering the texture of the paper toweling and closely resembling human skin in texture and feel and having sculpted detailed features, and an inner filling of soft material of sufficient density and compactness to resiliently maintain the shape of the squeezable figure.

* * * * *